United States Patent [19]

Hori

[11] 4,100,521

[45] Jul. 11, 1978

[54] IRON CORE FOR INDUCTION APPARATUSES

[75] Inventor: Yasuro Hori, Katsuta, Japan

[73] Assignee: Hitachi, Ltd., Japan

[21] Appl. No.: 568,192

[22] Filed: Apr. 15, 1975

[51] Int. Cl.[2] ..... H01F 27/24

[52] U.S. Cl. ..... 336/100; 336/212; 336/218; 336/234

[58] Field of Search ..... 336/218, 219, 233, 212, 336/234, 5, 10, 12, 214, 215, 20, 100

[56] References Cited

U.S. PATENT DOCUMENTS

| | | | |
|---|---|---|---|
| 2,300,964 | 11/1942 | Putman | 336/218 X |
| 2,372,074 | 3/1945 | Ford | 336/218 X |
| 2,387,943 | 10/1945 | Putman | 336/218 X |
| 2,393,038 | 1/1946 | Forbes | 336/218 X |
| 2,465,798 | 3/1949 | Granfield | 336/218 X |
| 2,506,393 | 5/1950 | Smoluehowski | 336/218 X |

FOREIGN PATENT DOCUMENTS

| | | | |
|---|---|---|---|
| 1,459,495 | 11/1966 | France | 336/218 |
| 1,050,438 | 2/1959 | Fed. Rep. of Germany | 336/218 |
| 23,288 | 6/1962 | German Democratic Rep | 336/218 |
| 1,488,357 | 4/1969 | Fed. Rep. of Germany | 336/218 |
| 693,288 | 6/1953 | United Kingdom | 336/218 |

*Primary Examiner*—Thomas J. Kozma
*Attorney, Agent, or Firm*—Craig and Antonelli

[57] ABSTRACT

An iron core for induction apparatuses is constructed of at least one main leg and yokes including side yokes comprising laminations of magnetic material. The magnetostriction of the yokes is smaller than that of the main legs, so that the vibration of the inductors is easily suppressed without any special means. Noise, which otherwise might arise from the vibration is thus reduced sharply.

8 Claims, 23 Drawing Figures

IRON CORE FOR INDUCTION APPARATUSES

The present invention relates to an iron core for induction apparatuses or more particular to an improvement in a method for reducing the vibration of the iron core used in the transformer.

Generally, the iron core for induction apparatuses comprises at least one main leg and yokes constructed of laminations of sheets of magnetic material such as silicon steel cut to length, the legs and yokes being joined at their ends with, say, a 45° oblique or rectangular contact with each other.

In the transformer with high- and low-voltage windings on the main legs of the core, it is well known that vibration having a fundamental frequency twice that of the commercial power supply frequency occurs and is transmitted through the iron core support and oil to the tank, wherefrom it is propagated in the air.

The vibration of the iron core is attributable to the magnetostriction of the magnetic material used for the core, that is the phenomenon of extension or contraction of the magnetic material in the direction of magnetization thereof with a certain magnetic flux density, and the magnitude of the vibration is dependent on the magnetostriction of the magnetic material, which in turn depends on the magnetic flux density.

It can be said that the noise caused by the vibration of the iron core account for most of the noise of transformers, and an effective measure supressing them is greatly desired.

The conventional means for preventing the noise from propagating outside the apparatus is to surround the whole transformer with a sound-absorbing wall of concrete or the like material, or to construct the tank with double walls, or to arrange noise-absorbing material or gas-contained bags of a noise-proofing material between the double walls of the tank. None of these methods, however, is efficient in its cost and in-effectiveness to solve the problem radically.

Another method so far employed to reduce transformer noise due to the vibration thereof is by improving the iron core itself, which is the source of the vibration, in such a mannner as to reduce the effect of magnetostriction thereon as far as possible. In such a method, the iron core is constructed of sheets of grain oriented silicon steel magnetic material subjected to little variation in magnetostriction determined by the magnetic flux density; or the magnetic material is annealed to remove the residual stress therein caused by the process of machining; or the iron core is operated under a certain value of magnetic flux density where the increase in magnetostriction is not great; or the sectional areas of the main legs and yokes of the iron core are increased to reduce the magnetic flux density thereof. These methods are not successful in complete elimination or reduction of the noises.

It was already mentioned that the vibration of the iron core is attributable to the magnetostriction (which may be generally expressed by the variation in length per unit length) varying in the direction of magnetization of the magnetic material of the main legs and the yokes in accordance with the magnetic flux density, the length of the main legs and yokes changing in a frequency twice that of the power supply frequency.

As a result of examination of the above-mentioned vibration of the iron core due to the magnetostriction of the magnetic material, the inventors discovered the facts described below.

Consider, for example, a rectangular single-phase iron core comprising a pair of main legs and a pair of yokes shorter than and joined in obliquely or rectangularly edgewise contact with the main legs each including a plurality of sheet laminations of the same material. Under normal conditions of use where the junctions of the main legs and yokes will not be displaced, the flow of a certain amount of magnetic flux causes the main legs and yokes to be extended by magnetostriction according to the magnetic flux density. In this case, the directions in extension of the legs and the yokes intersect each other at the junctions at right angles to each other, with the result that the main legs and the yokes are subjected to a force at their ends in such a direction perpendicular thereto as to be thrust apart by the yokes and the main legs respectively. In other words, the forces of extension of the main legs and the yokes are repeatedly applied to the ends of the yokes and the main legs respectively as in the case of a beam subjected to a vibrating force at the ends thereof, thus causing the vibration of the iron core. The results of the examination by the inventors also show that the magnetostriction of the yokes contributes to the vibration of the iron core much more than the main legs do, and that it is possible to reduce the vibration of the iron core greatly by reducing the magnetostriction of the yokes as will be described more in detail with reference to drawings later at the time of explanation of the invention.

The above-mentioned contributions of the main legs and the yokes to the iron core vibration are substantially the same in the three-phase as in the single-phase iron core.

The inventors have improved the iron core on the basis of the above findings and attained superior results as mentioned later.

An object of the present invention is to provide a novel and improved iron core for induction apparatus.

Another object of the invention is to provide an iron core for induction apparatus with reduced vibration.

Still another object of the invention is to reduce the noise of inductors by the use of the above-mentioned iron core with reduced vibration.

According to the present invention, there is provided; in an iron core for induction apparatus comprising at least one main leg and at least a pair of yokes joined with the main legs, each including a plurality of laminations of magnetic material, the improvement wherein the magnetostriction in the yokes is rendered smaller than that of the main legs.

In this way, the vibration of the iron core is suppressed and the noise of the inductors prevented from being aggravated. The ratio of the magnetostriction of the yokes to that of the main legs can be selected at a value effective in controlling the vibration. Further, in order to lessen the magnetostriction of the yokes as compared with that of the main legs, the yokes are comprised of a magnetic material with superior magnetostriction characteristics or specially processed for prevention of the deterioration of magnetostriction characteristics, and/or the sectional area of the yokes as relative to that of the main legs is enlarged thereby to reduce the magnetic flux density in the yokes.

Incidentally, the yokes referred to herein include not only what are generally called the "yokes" into which magnetic fluxes flow in but also the "side yoke" which is a leg arranged opposite in parallel to the main leg or legs and has the same function as the main legs.

The above and other objects, features and advantages will be made apparent by the detailed description taken in conjunction with the accompanying drawings, in which:

FIG. 5 to FIGS. 8A and 8B are diagrams showing front views and the vibration characteristics of single-phase iron cores to which the invention has been applied;

Figure 11A:
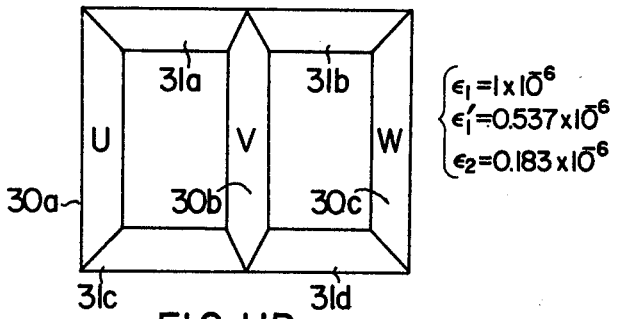
Figure 11B:
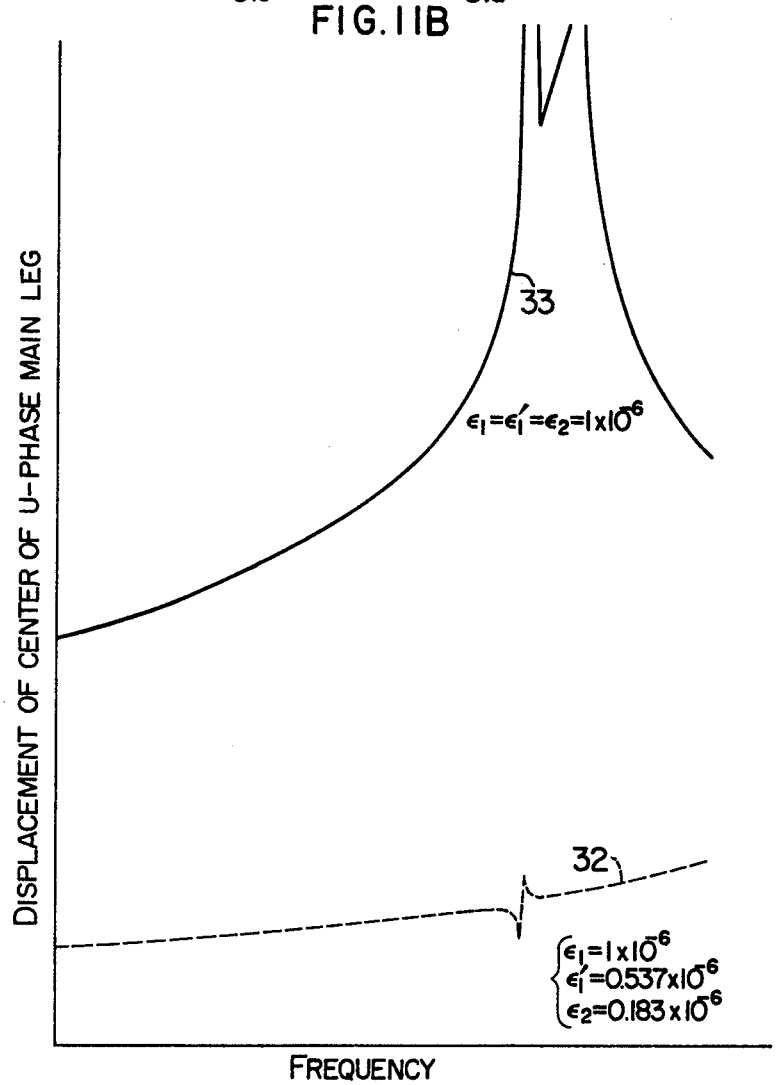
Figure 12A:
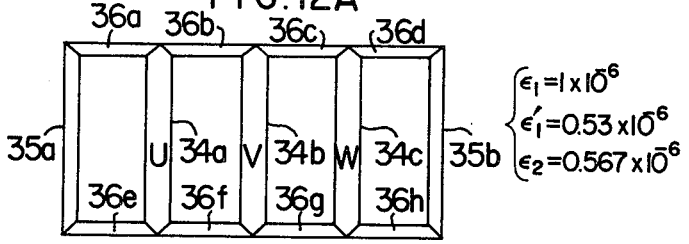
Figure 12B:
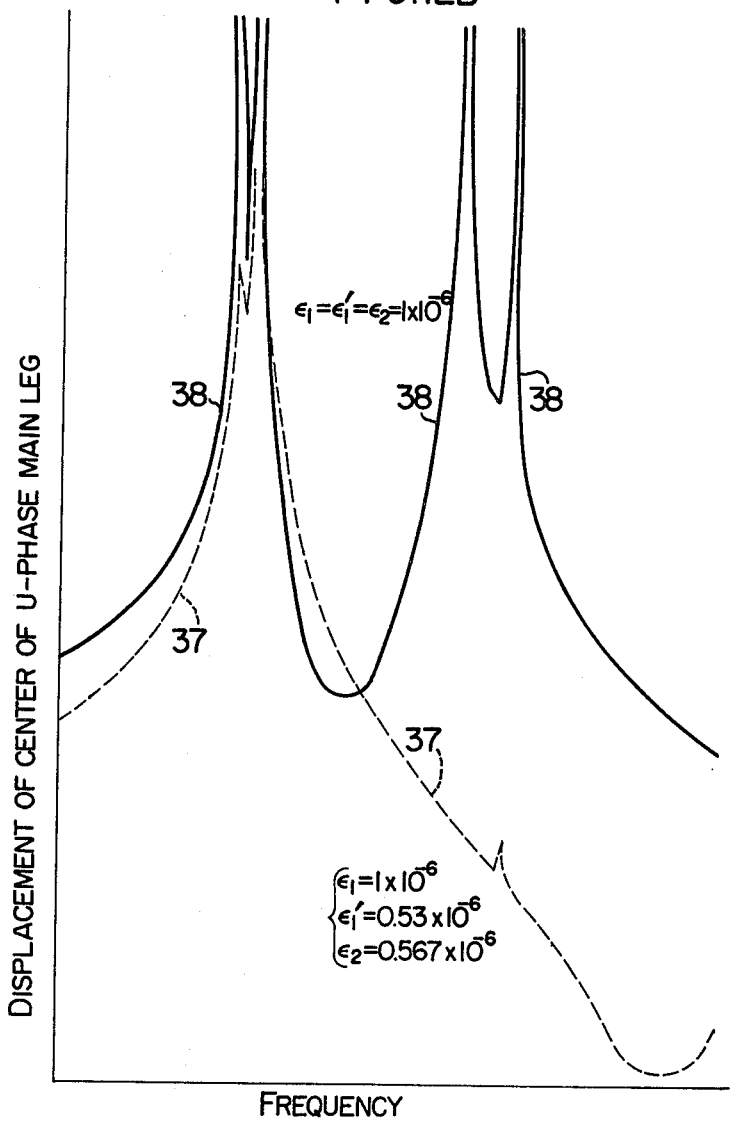
Figure 13:
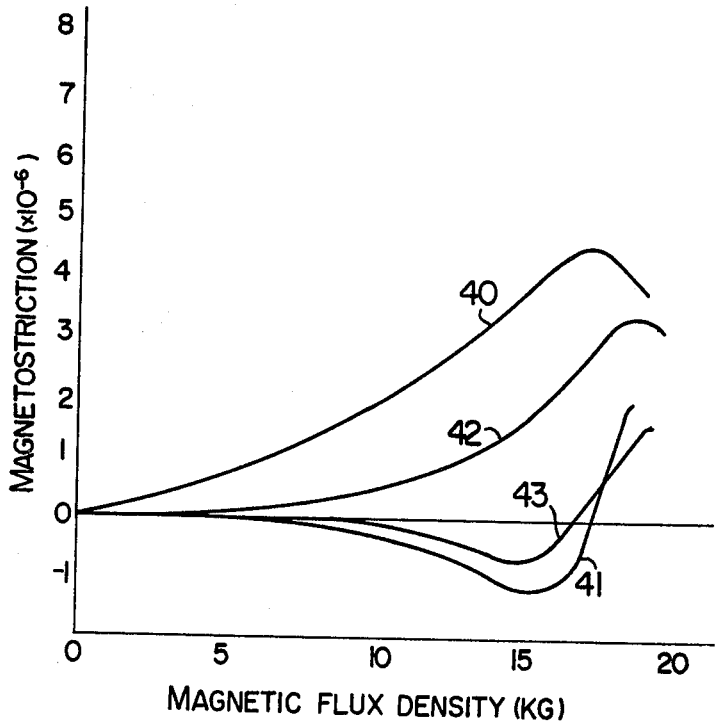
Figure 14:
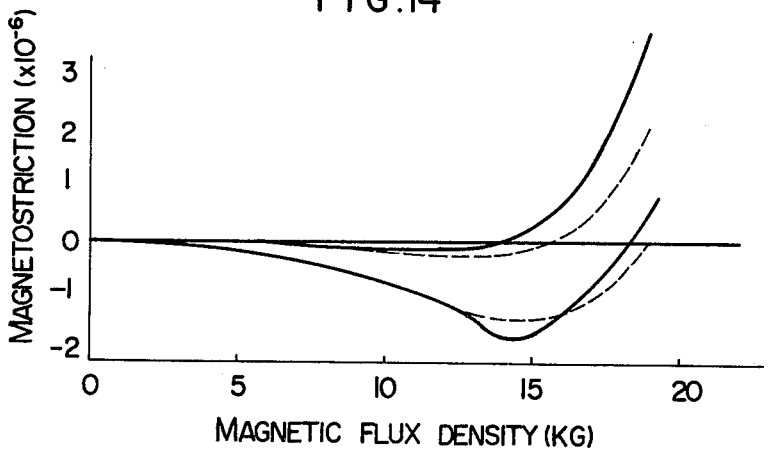
Figure 15:
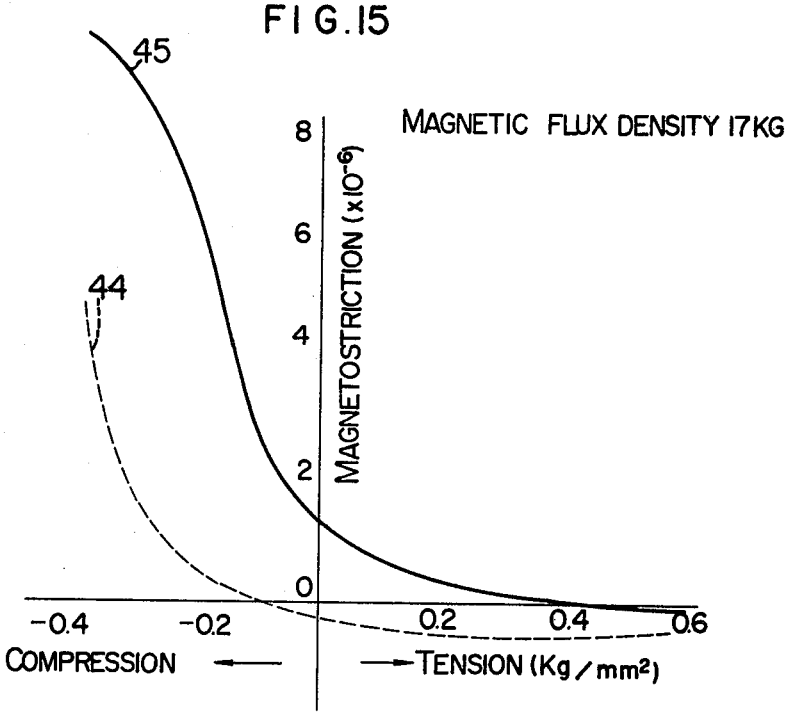

FIGS. 11A and 11B of FIGS. 12A and 12B show front views and vibration characteristics of three-phase iron cores to which the present invention is applied;

FIG. 13 shows magnetostriction characteristics of various magnetic materials used for the iron core; and FIGS. 14 and 15 show magnetostriction characteristics of the magnetic material of the iron core before and after a stress relieving treatment, respectively.

The invention will be described below with reference to the accompanying drawings.

Figure 1:
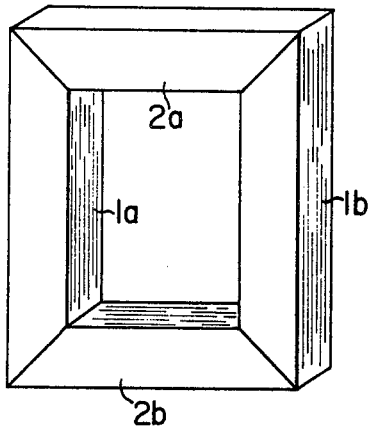
FIG. 1 shows a perspective view of a single-phase iron core.

The diagram of FIG. 1 shows a single-phase iron core comprising right and left main legs 1*a* and 1*b* and shorter upper and lower yokes 2*a* and 2*b* joined integrally in 45° oblique edgewise contact with each other as well known, each including a plurality of laminations of sheets of magnetic material cut to length.

Figure 2:
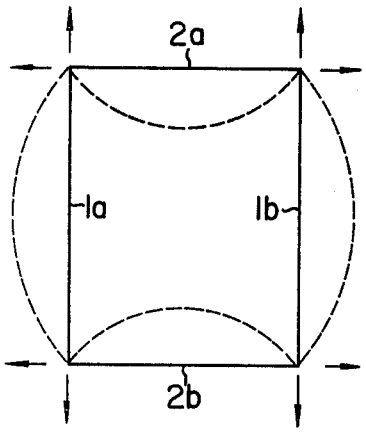
FIG. 2 is a diagram for explaining the vibration mode of the single-phase iron core of FIG. 1 at the commercial power supply frequency.

In the event that the above-mentioned iron core is magnetized at a predetermined magnetic flux density, the main legs 1*a* and 1*b* and the yokes 2*a* and 2*b* are displaced by the magnetostriction corresponding to the magnetic flux density in the direction of the magnetization due to the magnetostriction characteristic of the magnetic material used. This displacement due to the magnetostriction operates in the directions shown by arrows in FIG. 2 for both the main legs 1*a* and 1*b* and the yokes 2*a* and 2*b* shorter than the main legs. In other words, the displacement of the main legs 1*a* and 1*b* and the yokes 2*a* and 2*b* due to the magnetostriction thereof occurs at right angles to each other at the junctions thereof.

Figure 3:
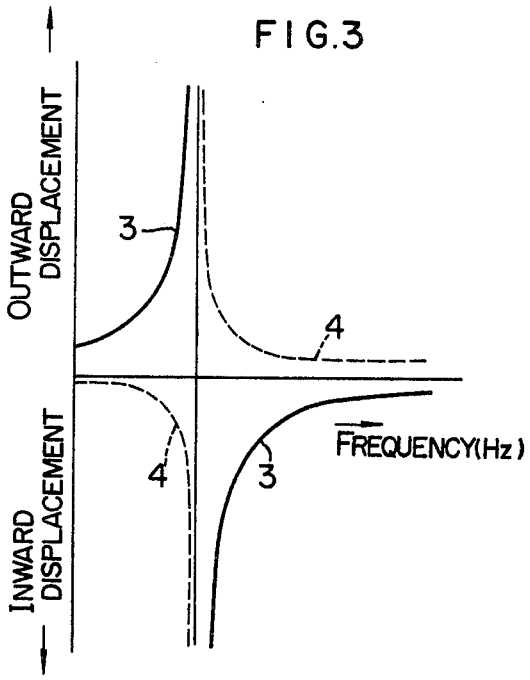
FIG. 3 is a graph showing the displacement of the iron core at various frequencies.

The displacement of the main legs and yokes poses no problem if it results in a corresponding relative displacement between the junctions of the iron core. However, in view of the fact that the generally used oblique or rectangular junctions are so constructed as to be prevented from any relative displacement therebetween, the displacement of the main legs 1*a* and 1*b*, that is, the long sides due to magnetostriction thereof causes a force perpendicular thereto to be exerted upon the ends of the yokes 2*a* and 2*b*, that is, the short sides, and vice versa. In the case of the AC current which provides the direction of magnetization alternately, the displacement due to the magnetostriction undergoes a change from zero to a maximum twice in every cycle of the AC current, apart from the direction of magnetization. As a result, the ends of the main legs 1*a* and 1*b* and the yokes 2*a* and 2*b* of the iron core are subjected repeatedly to a displacing force due to the magnetostriction twice as frequent as the power supply frequency, so that the iron core vibrates in the vibration mode as shown by the dashed lines in FIG. 2. The vibration of the main leg 1*a* is symmetric with respect to that of the main leg 1*b*, and the vibration of the yoke 24 with respect to that of the yoke 2*b*. As will be described later again, the displacement of the main legs due to magnetostriction is in such a direction as to lessen the vibration mode, whereas the displacement of the yokes acts in the direction to increase the vibration. The vibration characteristics of the iron core are such that, as shown in FIG. 3, the vibration displacement of the center of the main legs as against vibration frequencies is as shown by solid lines 3 if the displacement occurs only in the main legs, and by dashed lines 4 if it occurs only in the yokes. As will be seen from these curves, the vibration displacement of the legs is opposite in direction and different in magnitude depending on which of the legs and yokes undergo the displacement. In fact, the vibration displacement of the whole iron core is the sum of the displacement represented by the curves 3 and 4 and therefore will be substantially zero if the displacements as shown by the curves 3 and 4, are equal in magnitude and opposite in direction.

Figure 4A:
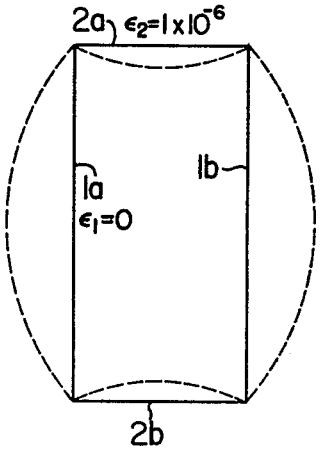
FIG. 4A and FIG. 4B are diagrams for explaining the vibration displacement of the main legs and yokes of the single-phase iron core of FIG. 1 when their magnetostriction is zero.
Figure 4B:
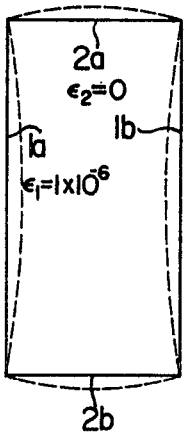

The contribution of the magnetostriction to the vibration displacement of the iron core, as calculated in the neighbourhood of the primary resonance frequency of the bending vibration in a plane including the longitudinal axes of the legs, is shown in FIG. 4A when the magnetostrictions of the main legs 1*a* and 1*b*, and the yokes, shorter than the legs, are given $\epsilon_1 = 0$ and $\epsilon_2 = 1 \times 10^{-6}$, respectively and in FIG. 4B when $\epsilon_1 = 1 \times 10^{-6}$ and $\epsilon_2 = 0$. It is because the vibration would become infinitely large, making a comparative study impossible, if the resonance frequency would be used for the calculation, that the calculation was rendered at the frequency in the neighbourhood of the resonance frequency where the vibration is relatively high and the vibration mode constant, thus making it possible to determine the direction and magnitude of the vibration with comparative case.

The result of the comparison shows that the contribution by the magnetostriction of only the yokes is at least three times as much as that of only the main legs.

In view of the fact that magnetostriction occurs in all the magnetic materials used for the iron core, the present invention utilizes the above-mentioned result of calculation for reducing the vibrations in such a manner that smaller magnetostriction occurs in the yokes than in the main legs by setting the ratio of the values of the magnetostriction the main legs and the yokes appropriately. Consequently, as will be seen from the embodiments described later, the vibration of the iron core is reduced to such an extent as to sharply reduce the noise which has so far been produced from induction apparatus or the like using the above-mentioned type of iron core.

In order to lessen the magnetostriction of the yokes, the means as mentioned below are employed.

A first of such means, as shown in FIG. 13, utilizes the fact that the magnetostriction as related to the magnetic flux density differs with the magnetic material used for the iron core. In the drawing under consideration, reference numeral 40 shows a characteristic curve of a non-grain oriented silicon steel sheet, numeral 42 a characteristic curve of an ordinary lowgrade grain oriented silicon steel sheet, numeral 43 a characteristic curve of a high-grade grain oriented silicon steel sheet, and numeral 41 a characteristic curve of a highest-grade grain oriented silicon sheet.

As will be seen, the magnetostriction as related to the magnetic flux density is reduced progressively accordingly as the silicon steel sheet changes from non-grain oriented to higher grade grain oriented states. By the use of this fact, the main legs and yokes of the iron core are selected from various materials and combined. For example, non-grain oriented silicon steel sheets exhibiting large magnetostriction are used as the magnetic material of the main legs, while grain-oriented silicon steel sheets are employed as the magnetic material of the yokes. Alternatively, the main legs made of low-grade grain oriented silicon sheets may be combined with the yokes of higher-grade grain oriented silicon sheets. Thus it is possible to reduce the magnetostriction of the yokes as compared with the main legs, thereby effectively reducing the vibration.

Another means consists in taking advantage of the fact that the magnetostriction of the same magnetic material varies with the magnetic flux density as shown in FIG. 13. In other words, the sectional area of the yokes is increased as compared with that of the main legs in such a manner as to reduce the magnetic flux density of the yokes accordingly, thereby reducing the magnetostriction caused therein to achieve the same purpose as in the preceding case. In this case, a conspicuous result is obtained by increasing the sectional area of the yokes by 10% or more depending on the degree to which the reduction of vibration is desired.

In still another means, the fact is utilized that, as shown in FIG. 14, the magnetostriction of the magnetic material as related to the magnetic flux density is different according to whether the magnetic material has been heat treated or not after the cutting process. In the drawing under consideration, the solid lines show characteristics curves representing the upper and lower limits of magnetostriction in the absence of stress-relieving annealing, while the dashed lines are characteristics curves showing the upper and lower limits of the magnetostriction of the magnetic material subjected to the stress relieving annealing. In the fabrication of an iron core, it is common practice to use a plurality of sheets of magnetic material produced from the same lot and therefore variations of the magnetostriction of different sheets of magnetic material are very small. The same purpose as that of the preceding means is achieved by using an unannealed magnetic material large in magnetostriction as the main legs, and an annealed magnetic material small in magnetostriction as the yokes. Also, the magnetic material of the iron core subjected to the stress relieving annealing process is less affected than the unannealed magnetic material by the compression applied thereto during the festening process in the assemblage of the induction, as will be obvious from the characteristics curves 44 and 45 in FIG. 15 associated with the annealed and unannealed magnetic materials respectively.

Still another means takes advantage of the variations in magnetostriction which arise from different methods of cutting or subjecting to like process the magnetic material. The effect of the physical processing of the magnetic material in such greater on the magnetostriction thereof than on the iron loss or exciting current, resulting in magnetostriction being increased extremely as compared with the iron loss or exciting current. Therefore, a magnetic material subjected to an ordinary cutting process is used for the main legs, whereas the sheets of the yokes are cut without any mechanical stress thereby to prevent an increase of the magnetostriction which otherwise might present itself to a greater extent by magnetostriction. For this purpose, the feed rollers of the cutting apparatus, for example, may be made of rubber to prevent an unreasonably high tension from being applied to the magnetic material so that the resulting sheets of magnetic material may exhibit less magnetostriction and hence cause less vibrations of the iron core.

Alternatively, some of the above-mentioned various means may be combined or the tension may be applied to the magnetic material of the yokes to reduce the magnetostriction thereof. In one example of such combinations, a magnetic superior in magnetostriction characteristic is used for the yokes while at the same time enlarging the sectional area of the yokes to achieve the purpose of reducing the vibration of the iron core by further reducing the magnetostriction of the yokes as compared with that of the main legs.

Explanation will be made below of the vibration characteristics of single-phase iron cores according to various embodiments of the invention in which the magnetostriction of the main legs is different from that of the yokes.

Figure 5A:
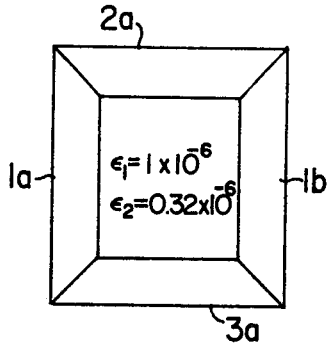
Figure 5B:
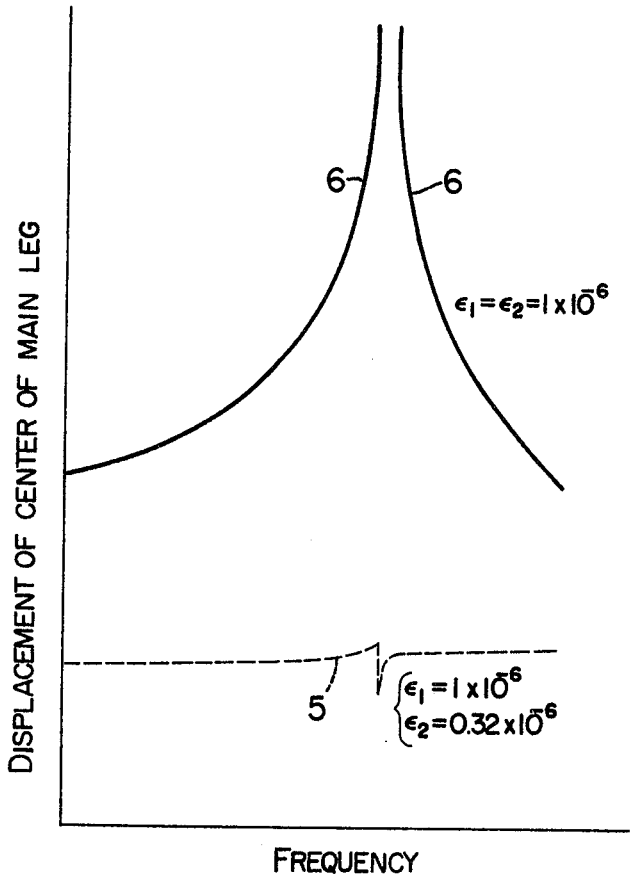

The diagram of FIG. 5A shows a single-phase two-leg iron core, similar to the iron core of FIG. 1, comprising a couple of main legs 1*a* and 1*b* and couple of yokes 2*a* and 3*a* which have the length one half that of the legs and are obliquely joined with the legs. The magnetostriction of the main legs and the yokes are made $\epsilon_1 = 1 \times 10^{-6}$ and $\epsilon_2 = 0.32 \times 10^{-6}$ respectively according to the principle of the invention. The vibration of this iron core as measured is such that the displacement of the center of the main legs is substantially zero against frequency variations and its characteristic curve is almost flat as shown by the dashed line 5 in FIG. 5B. This compares with the characteristic curves 6 of the conventional iron core in which the magnetostriction is $\epsilon_1 = \epsilon_2 = 1 \times 10^{-6}$ for both the legs and yokes. It will be thus noted that the iron core according to the invention is much less in vibration displacement than the conventional iron core.

Figure 6A:
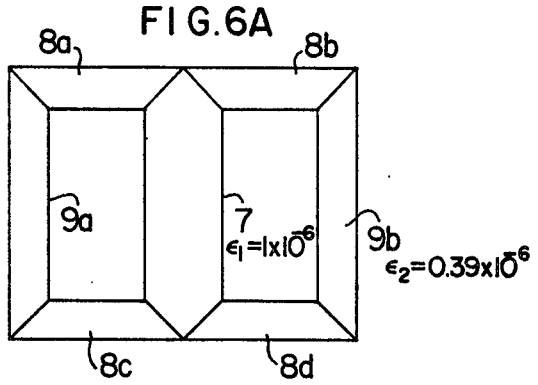
Figure 6B:
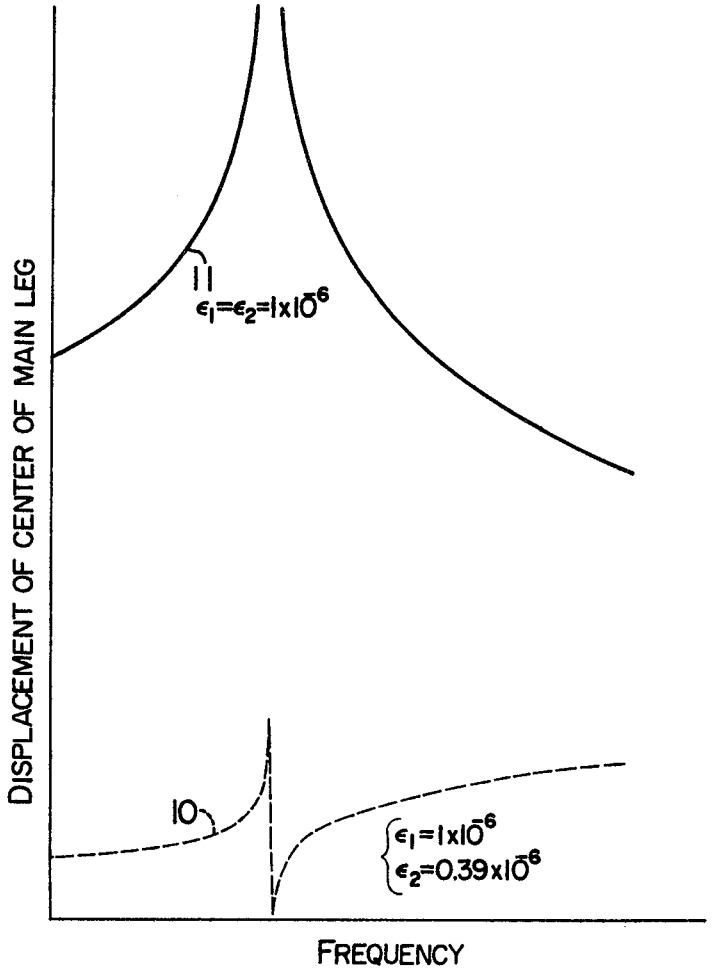

The diagram of FIG. 6A shows what is called a single-phase three-leg iron core comprising one main leg 7, upper and lower yokes 8*a*, 8*b*, 8*c* and 8*d* and two side yokes 9*a* and 9*b* in parallel to the main leg and having the same function as the yokes, all joined obliquely at the ends, and in which the magnetostriction of the main leg is made $\epsilon_1 = 1 \times 10^{-6}$ and that of the yokes and side yokes $\epsilon_2 = 0.39 \times 10^{-6}$. The calculated vibration of the iron core under consideration is represented by the characteristic curve 10 in FIG. 6B, which shows that the center of the main leg undergoes less changes against frequency variations and is lower in the maximum value of resonant displacement than in the case of the conventional iron core involving the magnetostriction of $\epsilon_1 = \epsilon_2 = 1 \times 10^{-6}$ for all the parts thereof as shown by the characteristic curve 11.

Figure 7A:
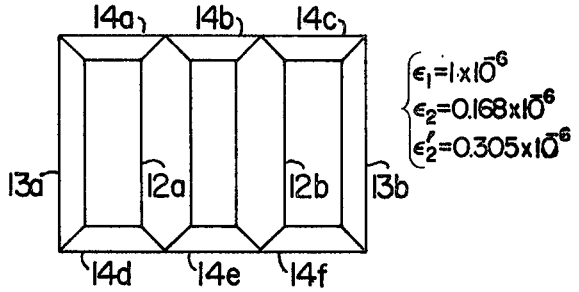
Figure 7B:
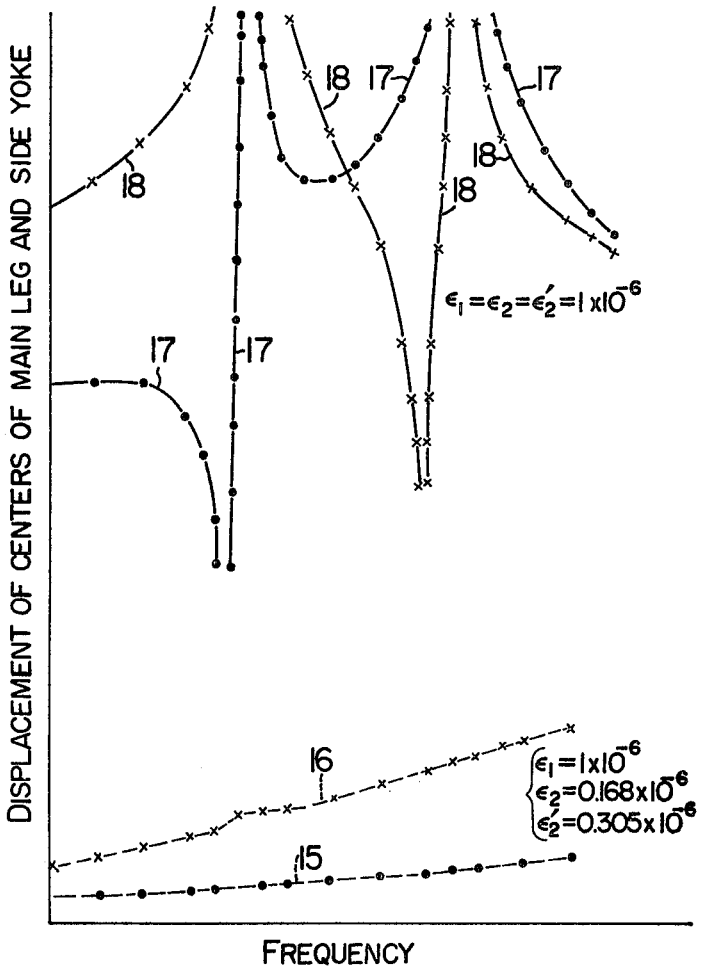

The diagram of FIG. 7A shows what is called a single-phase four-leg iron core comprising a couple of main legs 12a and 12b, a couple of side yokes 13a and 13b, and the yokes 14a to 14f interposed therebetween, all joined obliquely with each other at their ends; in which the magnetostriction of the main legs is made $\epsilon_1 = 1 \times 10^{-6}$, that of the yokes 14b and 14e $\epsilon_2 = 0.168 \times 10^{-6}$, and that of the other yokes and the side yokes $\epsilon_2' = 0.305 \times 10^{-6}$. In the iron core according to this embodiment, the displacement of the center of the main legs as against frequencies is shown by the characteristic curve 15, and that of the center of the side yokes by the characteristic curve 16 in FIG. 7B. From this, it will be understood that the displacement due to vibration is sharply reduced and there is substantially no resonance unlike the conventional iron core with its all parts having the same magnetostriction of $\epsilon_1 = \epsilon_2 = \epsilon_2' = 1 \times 10^{-6}$ as represented by the characteristics curves 17 and 18 for the centers of the main legs and side yokes respectively.

Figure 8A:
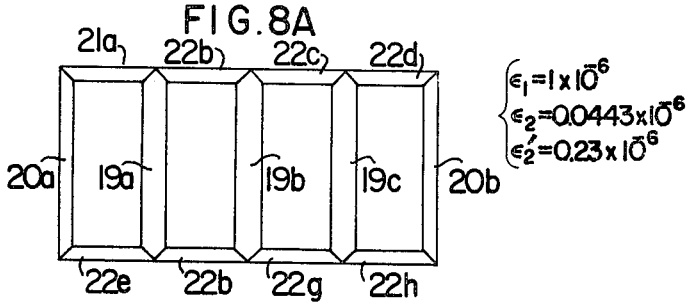
Figure 8B:
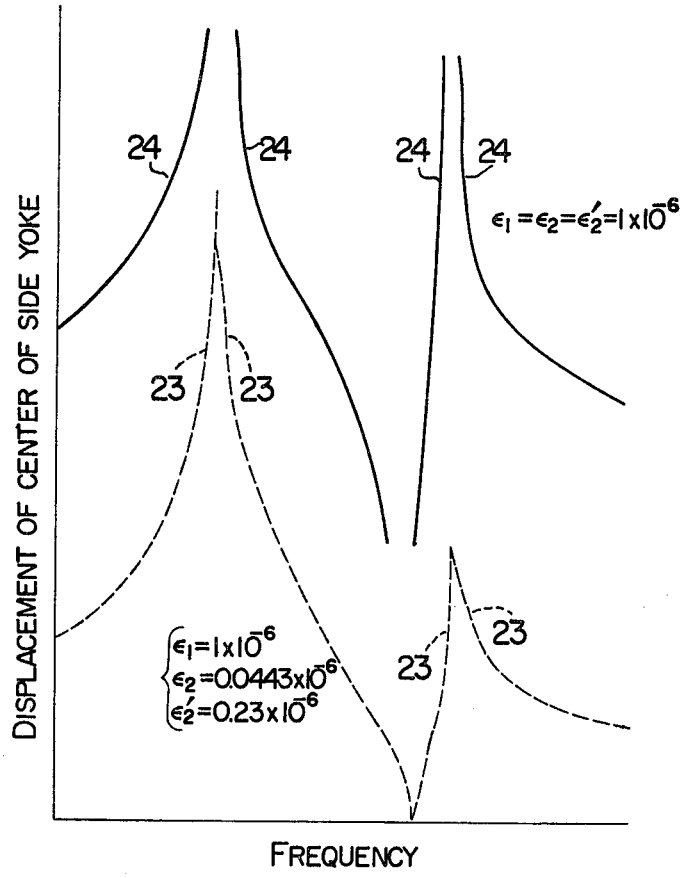

What is called a single-phase five-leg iron core is shown in FIG. 8A. This embodiment comprises three main legs 19a, 19b and 19c, a couple of side yokes 20a and 20b, and the yokes 21a to 22h, all joined obliquely with each other at their ends. The magnetostriction of the embodiment under consideration is set at $\epsilon_1 = 1 \times 10^{-6}$ for the main legs, $\epsilon_2 = 0.0443 \times 10^{-6}$ for the yokes 22b, 22c, 22f and 22g between the main legs, and $\epsilon_2' = 0.23 \times 10^{-6}$ for the remaining yokes and the side yokes. The vibration of this iron core is as shown in FIG. 8B in which the center of the side yokes undergoes a displacement against frequencies as shown by the characteristic curve 23. As can be seen, the displacement due to magnetostriction as well as the vibration displacement at resonance is smaller in the embodiment than in the conventional iron core with all its parts having the magnetostriction of $\epsilon_1 = \epsilon_2 = \epsilon_2' = 1 \times 10^{-6}$ as represented by the characteristic curve 24.

It will be obvious from the foregoing description that regardless of the shape of the iron core, the vibration of the iron core may be reduced as compared with the conventional iron core with any types of joints between the various parts thereof by lessening the magnetostriction of the yokes as compared with that of the main legs. In spite of the fact that the magnetostriction of the yokes should preferably be minimized, the degree of reduction thereof may be determined taking into consideration the value of an allowable vibration, namely, the degree to which the noise of the inductor involved is desired to be reduced. At least, it can be said that if the vibration is to be successfully reduced, the magnetostriction of the yokes must be not more than half that of the main legs. And this ratio must be increased to three times or more if a more successful result is desired.

Figure 9:
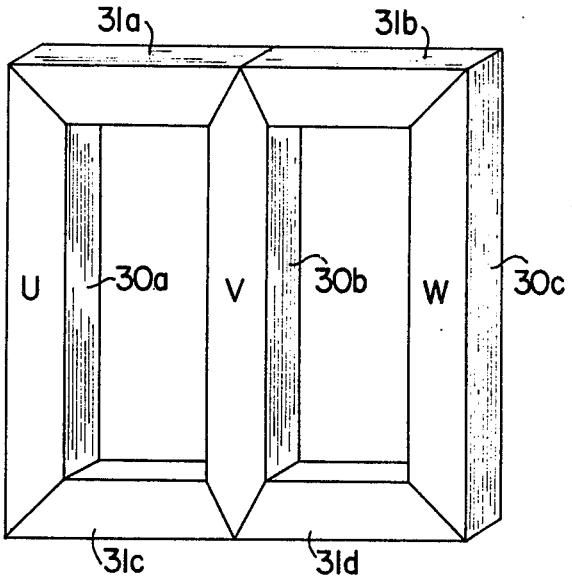
FIG. 9 shows a perspective view of a three-phase three-leg iron core.

Reference is made to FIG. 9 showing an ordinarly three-phase three-leg iron core comprising three main legs 30a, 30b and 30c for phases U, V and W respectively, and the yokes 31a to 31d, all joined obliquely with each other at their ends.

Figure 10A:
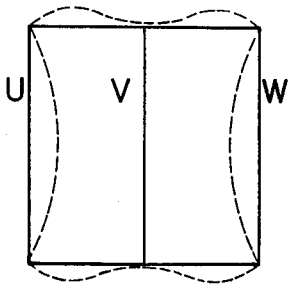
FIGS. 10A and 10B are diagrams for explaining the symmetric and non-symmetric vibration modes respectively of the three-phase iron core of FIG. 9 at the commercial power supply frequency.
Figure 10B:
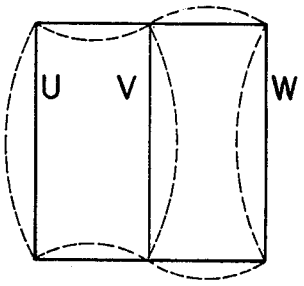

The three-phase iron core has a phase difference of 120° between the magnetic fluxes of the main legs of respective phases and therefore there is naturally a similar phase difference between the magnetostriction according to the magnetic flux density of the respective parts of the iron core. For this reason, the vibration mode of the three-phase iron core cannot be considered in the same way as that of the single-phase iron core. Instead, the vibration mode for the three-phase iron core must take into consideration not only the symmetric vibration mode shown in FIG. 10A but also the non-symmetric vibration mode shown in FIG. 10B. In this case, the vibration displacement in the neighbourhood of the resonance frequency was calculated with the magnetostriction of the main legs or specified ones thereof or the yokes at, say, $1 \times 10^{-6}$ and that of the others at zero, as in the case of the single-phase iron core. In the symmetric vibration mode shown in FIG. 10A, the magnetostriction acts on the main legs and yokes in such a direction as to increase the vibration. In this vibration mode, therefore, the vibration is reduced by the use of a magnetic material with a negative magnetostriction for the main legs or the yokes. On the other hand, the nonsymmetric vibration mode shown in FIG. 10B is such that the magnetostriction of the main legs of phases U and W on both sides acts opposedly to and to a lesser extent than that of the V-phase center main leg and the yokes. After all, as far as the three-phase iron core is concerned, the vibration is effectively dampened by reducing the magnetostriction of the V-phase main leg and the yokes. Also, the mere reduction in the magnetostriction of the yokes contributes to the attenuation of vibrations as compared with the conventional iron core. Whether only the yokes or the yokes and the V-phase center main leg should be reduced in magnetostriction is determined depending on the degree of vibration reduction desired.

Any of the above-mentioned methods may be selected for reduction of magnetostriction.

The three-phase three-leg iorn core shown in FIG. 11A is similar to the one shown in FIG. 9 in construction but subjected to the magnetostriction of $\epsilon_1 = 1 \times 10^{-6}$ at the main legs 30a and 30c, $\epsilon_1' = 0.537 \times 10^{-6}$ at the central main leg, and $\epsilon_2 = 0.183 \times 10^{-6}$ at the yokes 31a to 31d. The displacement of the center of the U-phase main leg against frequency variations is shown by the characteristic curve 32 in FIG. 11B. It will be seen that the displacement in this case is smaller than the conventional similar iron core with the magnetostriction of all the parts thereof set at $\epsilon_1 = \epsilon_1' = \epsilon_2 = 1 \times 10^{-6}$ as represented by the characteristic curve 33. In addition, there occurs substantially no resonance of vibration.

The embodiment of FIG. 12A is what is called a three-phase five-leg iron core comprising main legs 34a, 34b and 34c for the respective phases, a couple of side yokes 35a and 35b, and yokes 36a to 36h, all obliquely joined with each other. The magnetostriction of the main legs 34a and 34c is set at $\epsilon_1 = 1 \times 10^{-6}$, that of the central main leg 34b at $\epsilon_1' = 0.53 \times 10^{-6}$, and that of the yokes and the side yokes at $\epsilon_2 = 0.567 \times 10^{-6}$. The displacement of the center of the U-phase main leg against frequency variations is shown in the characteristic curve 37, from which it is apparent that the displacement is smaller than that of the conventional iron core represented by the characteristic curve 38. Especially at a high frequency range, no resonance of vibration occurs unlike the conventional iron core.

It will be thus understood from the above description that according to the present invention the vibration of both single- and three-phase iron cores is effectively dampened and therefore the noise of induction apparatuses is successfully reduced.

What is claimed is:

1. In an iron core for induction apparatuses comprising at least one main leg to be mounted with windings and at least a pair of yokes joined with said main legs, each including a plurality of laminations of silicon steel, the improvement wherein said yokes are formed of silicon steel having a lower magnetostriction with respect to a given magnetic flux density than that of the silicon steel of said main legs, and the magnetostriction of said main legs is at least double that of said yokes with respect to said given magnetic flux density.

2. An iron core according to claim 1, comprising three legs of phases U, V and W, wherein the magnetostriction of said main leg of phase V and said yokes is rendered smaller than that of said main legs of phases U and W.

3. An iron core according to claim 1, wherein each of said yokes comprises a plurality of laminations of grain oriented silicon steel sheets higher in grade than the silicon steel sheets constituting said main legs.

4. An iron core according to claim 1, wherein each of said yokes comprises a plurality of laminations of silicon steel sheets so machined as to reduce the mechanical strain and hence the magnetostriction thereof compared with the silicon steel sheets of said main legs.

5. An iron core according to claim 1, wherein each of said main legs comprises a plurality of laminations of silicon steel sheets not subjected to a stress relieving annealing process, and each of said yokes comprises a plurality of laminations of silicon steel sheets subjected to a stress relieving annealing process.

6. An iron core according to claim 1, wherein said yokes are enlarged in sectional area so that the magnetic flux density of said yokes is lower than that of said main legs.

7. An iron core according to claim 1, wherein said yokes have a larger sectional area than that of said main legs.

8. In an iron core for induction apparatuses comprising at least one main leg and at least a pair of yokes joined with said main leg, said main leg and said yokes being formed of a plurality of laminations of magnetic material; the improvement wherein said main legs and said yokes are formed of grain oriented silicon steel, said yokes being formed of higher grade grain oriented silicon steel than that of said main leg so that the magnetostriction of said main leg is at least double that of said yokes with respect to a given magnetic flux density.

* * * * *